US006748876B2

(12) United States Patent
Preisler et al.

(10) Patent No.: US 6,748,876 B2
(45) Date of Patent: Jun. 15, 2004

(54) REINFORCED COMPOSITE PALLET ASSEMBLY OF THE SANDWICH-TYPE WITH A LOCALLY CRUSHED CELLULAR CORE

(75) Inventors: Darius J. Preisler, Macomb, MI (US); Lloyd R. Hilligoss, South Lyon, MI (US)

(73) Assignee: Patent Holding Company, Fraser, MI (US)

( * ) Notice: Subject to any disclaimer, the term of this patent is extended or adjusted under 35 U.S.C. 154(b) by 27 days.

(21) Appl. No.: 10/208,506

(22) Filed: Jul. 30, 2002

(65) Prior Publication Data

US 2003/0079659 A1 May 1, 2003

Related U.S. Application Data

(63) Continuation-in-part of application No. 10/016,081, filed on Oct. 30, 2001, now Pat. No. 6,655,299.

(51) Int. Cl.[7] ..... B65D 19/38
(52) U.S. Cl. ..... 108/57.25; 108/51.3
(58) Field of Search ..... 108/57.25, 57.27, 108/57.28, 51.3, 51.11, 901, 902

(56) References Cited

U.S. PATENT DOCUMENTS

| | | | | |
|---|---|---|---|---|
| 3,695,188 A | * | 10/1972 | Granatstein | 108/57.28 |
| 3,719,157 A | * | 3/1973 | Arcocha et al. | 108/57.25 |
| 4,013,021 A | * | 3/1977 | Steinlein et al. | 108/57.25 |
| 4,507,348 A | * | 3/1985 | Nagata et al. | 428/172 |
| 4,937,125 A | | 6/1990 | Sammartin et al. | |
| 5,337,681 A | | 8/1994 | Schrage | |
| 5,365,859 A | | 11/1994 | Schrage | |
| 5,413,052 A | * | 5/1995 | Breezer et al. | 108/56.1 |
| 5,497,709 A | | 3/1996 | Gonzalez et al. | |
| 5,566,624 A | * | 10/1996 | Brown et al. | 108/57.28 |
| 5,596,933 A | | 1/1997 | Knight et al. | |
| 5,673,630 A | | 10/1997 | Schutz | |
| 5,676,064 A | * | 10/1997 | Shuert | 108/57.25 |
| 5,683,782 A | | 11/1997 | Duchene | |
| 5,687,652 A | | 11/1997 | Ruma | |
| 5,720,229 A | | 2/1998 | Schrage | |
| 5,755,162 A | | 5/1998 | Knight et al. | |
| 5,791,262 A | | 8/1998 | Knight et al. | |
| 5,806,436 A | | 9/1998 | Weichenrieder | |

(List continued on next page.)

FOREIGN PATENT DOCUMENTS

| | | |
|---|---|---|
| EP | 0 473 422 A1 | 3/1992 |
| EP | 0 551 776 A1 | 7/1993 |
| EP | 0 649 736 A1 | 4/1995 |
| EP | 0 783 959 A2 | 7/1997 |
| FR | 79 23257 | 4/1980 |
| FR | 2711573 | 5/1995 |
| WO | WO 88/03086 | 5/1988 |

*Primary Examiner*—Jose V. Chen
(74) *Attorney, Agent, or Firm*—Brooks Kushman P.C.

(57) ABSTRACT

A reinforced composite pallet assembly of the sandwich-type having a cellular core which is locally crushed is provided. The assembly includes a pair of substantially flat decks having front, back and side edges. Each of the decks includes a load-bearing skin made of a reinforced thermoplastics material, a grid of reinforcing slats, a cellular core made of a thermoplastics material, and a tine-engaging skin made of a reinforced thermoplastics material. The grid of reinforcing slats is positioned at predetermined places against the tine-engaging skins. The distance between the skins of each deck is reduced during molding of the deck which molding locally crushes the core at the predetermined places. A plurality of supports support the decks at the predetermined places against the reinforcing slats so that tines can lift and support the pallet assembly at the tine-engaging skin. The resulting assembly is ultra light weight, meeting all forecasted government weight restrictions. Other features include molded-in features added as part of the forming process (i.e., pockets, grooves, and/or ribs on retraining walls).

20 Claims, 2 Drawing Sheets

U.S. PATENT DOCUMENTS 5,845,588 A * 12/1998 Gronnevik ..... 108/57.27
5,865,315 A 2/1999 Uitz
5,868,080 A 2/1999 Wyler et al.
5,888,610 A 3/1999 Fournier et al.
5,891,560 A 4/1999 Edwards et al.
5,921,189 A 7/1999 Estepp
5,937,767 A 8/1999 Togawa et al.
5,950,546 A 9/1999 Brown et al.
5,967,057 A * 10/1999 Nakayama et al. ..... 108/57.25
6,006,677 A 12/1999 Apps et al.
6,050,630 A 4/2000 Hochet
6,125,770 A 10/2000 Brandenburg
6,155,181 A 12/2000 Chilcutt
6,165,604 A 12/2000 Edwards et al.
6,173,657 B1 1/2001 Espejo
6,180,203 B1 1/2001 Unkles
6,187,411 B1 2/2001 Palmer
6,199,488 B1 3/2001 Favaron et al.
6,216,608 B1 4/2001 Woods et al.
6,357,366 B1 * 3/2002 Frankenberg ..... 108/57.25
6,389,990 B1 * 5/2002 Apps ..... 108/57.25
6,446,563 B1 * 9/2002 Ohanesian ..... 108/57.25

* cited by examiner

REINFORCED COMPOSITE PALLET ASSEMBLY OF THE SANDWICH-TYPE WITH A LOCALLY CRUSHED CELLULAR CORE

CROSS-REFERENCE TO RELATED APPLICATION

This application is a continuation-in-part of U.S. application entitled "A Reinforced Composite Pallet Assembly of the Cellular Core Sandwich-Type", filed Oct. 30, 2001 and having U.S. Ser. No. 10/016,081, now issued as U.S. Pat. No. 6,655,299.

BACKGROUND OF THE INVENTION

1. Field of the Invention

The present invention relates generally to pallet assemblies of sandwich-type composite structure having a cellular core and, in particular, to such pallet assemblies whose structure is reinforced locally.

2. Background Art

Sandwich-type materials having cellular cores have very important characteristics resulting from their being light in weight yet very rigid.

Conventionally, such a panel is constructed by sandwiching a cellular core having low strength characteristics by gluing it or bonding it between two skins, each of which is much thinner than the cellular core but has excellent mechanical characteristics.

The patent document FR 2 711 573 discloses a method of making a panel of sandwich-type composite structure having a cellular core. In that method, said panel is made in a single step by subjecting a preheated stack to cold-pressing in a mold, which stack is made up of at least a first skin made of a stampable reinforced thermoplastics material, of a cellular core made of a thermoplastics material, of a second skin made of a stampable reinforced thermoplastics material, and of a first external covering layer made of a woven or non-woven material, the skins and core being preheated outside the mold to a softening temperature.

Such a method is particularly advantageous because of the fact that it makes it possible, in a single operation, both to generate cohesion between the various layers of the composite structure, and to shape the panel.

The resulting panel conserves all of the mechanical properties imparted by the cellular core sandwich structure.

European patent EP 0 649 736 B1 explains the principle of molding substantially flat parts out of thermoplastic sandwich material (TSM). The part is made in a single stage by pressing in a cold mold, at a pressure in the range of 10 bars to 30 bars, a stack consisting of at least a first top skin layer of stampable reinforced thermoplastics material, a cellular or honeycomb core of thermoplastics material and a second bottom skin layer of stampable reinforced thermoplastics material. The axes of the cells of the cellular core are generally oriented perpendicular to the skin layers. The skin layers and core are previously heated outside the mold to a softening temperature. Such sandwich material is also described in U.S. Pat. No. 5,683,782. The cellular core of such material enables the part to be very rigid while being light in weight.

U.S. Pat. No. 6,050,630 discloses a molded composite stack including a cellular core for a vehicle and a mold for forming the stack into a vehicular part, such as a floor panel.

Panels of sandwich-type composite structures having a cellular core have strength characteristics sufficient to enable mechanical structures subjected to large stresses to be reinforced structurally without making them too heavy. Such panels are in common use in shipbuilding, aircraft construction, and rail vehicle construction.

However, the non-uniformness of the mechanical stresses to which they are subjected sometimes makes it necessary to form local reinforcing plies at those places in said panels where the mechanical stresses are greatest.

In the field of aircraft construction, sandwich structure composite panels are made that are based on thermosettable resins reinforced with fibers.

In order to impart the desired shapes to the panels, and to maintain the shapes, the fibers and the thermosettable resin (in the form of pre-impregnates) are deposited layer-by-layer in a mold, and are then heated to high temperatures so as to cure (i.e. polymerize) the resin permanently.

The molds used may have a punch and/or machining device integrated into the mold.

Making such locally-reinforced panels consists firstly in defining zones where stresses are concentrated in the resulting panels, such zones being defined either by real testing or by computer simulation, and then in adding reinforcing plies at those places so as to make it possible to withstand such stresses.

The reinforcing plies are one-directional mats or woven fabrics of glass fibers, of carbon fibers, or of natural fibers embedded in a thermosettable resin, with an orientation that is determined by the orientation of the stresses. They are cut out to a pattern using special machines, e.g. water-jet cutting machines.

The reinforcing plies are disposed layer-by-layer in a mold, either manually or by means of a robot, with each ply having its own orientation.

That operation may be referred to as the "laying up" operation.

Then comes the baking step which is the longest step of the method of making such pieces because the stack of layers must be heated sufficiently to cure the thermosettable resin.

The various layers disposed in the mold are pressed in the mold by evacuating the mold. Such evacuation serves to press the materials against the die or the punch, and to remove surplus resin.

The desired shape is thus obtained with the fibers being impregnated with the resin as well as possible.

That "lamination" technique, and in particular the "laying up" operation, is characterized by a very low level of automation, and a large labor input.

Although, by means of the concept of localizing the strength, that technique makes it possible to achieve performance levels that are high for the pieces that are made in that way, it requires rigorous monitoring of quality.

As a result, that technique is very costly and cannot be used at the high production throughputs implemented in many fields such as the automobile industry.

Generally, plastic pallets can be easily molded and are lighter in weight than wooden pallets. Also, such pallets are more mold, bacteria, pest and insect resistant. Furthermore, in general, plastic pallets are more durable than wooden pallets as shown in U.S. Pat. No. 5,497,709.

Plastics processing technology has enjoyed significant recent advances, such that traditional high-strength materials such as metals are being replaced with fiber composite materials. These materials are not only light, but also are flexible and durable.

U.S. Pat. Nos. 5,891,560 and 6,165,604 disclose fiber-reinforced composites prepared from a depolymerizable and repolymerizable polymer having the processing advantages of a thermoset without being brittle. Impregnation of polymer into the fiber bundle is achieved, while still producing a composite with desirable physical properties and high damage tolerance.

One factor that has limited the number of plastic pallets is that plastic pallets require a given amount of relatively expensive plastic material for a desired measure of pallet strength. U.S. Pat. Nos. 5,868,080 and 6,199,488 disclose reinforced plastic pallet constructions and assembly methods wherein multiple reinforcing bars are employed. The reinforcing bars preferably comprise composite structural members of fiberglass reinforced thermosetting plastic fabricated from a pultrusion process.

As noted in the above-mentioned '560 and '604 patents, although thermoset composites have excellent mechanical properties, they suffer from several disadvantages: thermoset matrices have relatively limited elongation, the thermoset precursors are a source of undesirable volatile organic compounds (VOCs), the composites cannot be reshaped or recycled, and their production rates are limited.

Other factors limiting the use of plastic pallets are the need for expensive equipment, long cycle times and high capital investment.

Consequently, in principle at least, thermoplastic composites would solve many of the problems associated with thermosets. For example, unlike thermosets, thermoplastics can be reshaped, welded, staked, or thermoformed. Furthermore, thermoplastics are generally tougher, more ductile, and have greater elongation than thermosets.

SUMMARY OF THE INVENTION

An object of the present invention is to provide a reinforced composite pallet assembly of the cellular core sandwich-type which can be made simply and cheaply, and can be implemented at high throughputs.

In carrying out the above object and other objects of the present invention, a reinforced composite pallet assembly of the sandwich-type having a cellular core is provided. The assembly includes a substantially flat deck having front, back and side edges and including: a) a load-bearing skin made of a reinforced thermoplastics material; b) a grid of reinforcing slats; c) a cellular core made of a thermoplastics material; and d) a tine-engaging skin made of a reinforced thermoplastics material. The grid of reinforcing slats is positioned at predetermined places against the tine-engaging skin, and the distance between the skins is reduced during molding of the deck which molding locally crushes the core at the predetermined places. The assembly further includes at least one support for supporting the deck at the predetermined places against the reinforcing slats so that tines can lift and support the pallet assembly at the tine-engaging skin.

Slats of the grid may be positioned adjacent to the front, back and side edges of the deck, and at least one of the slats may extend from positions adjacent the edges to a center of the deck.

The load-bearing skin may extend downwardly to the tine-engaging skin at the front, back and side edges of the deck so that the core is substantially totally enclosed by the skins and the edges are finished.

The assembly may further include another deck, wherein the at least one support interconnects the decks at their tine-engaging skins, and the assembly may be stackable or rackable.

The load-bearing skin of the another deck may extend upwardly to the tine-engaging skin at the front, back and side edges of the deck so that the core of the another deck is substantially totally enclosed by the skins of the another deck and its edges are finished.

At least one reinforcing slat may be received and retained within a cavity formed between the tine-engaging skin and the at least one support.

A plurality of supports may support the deck, and the reinforcing slats may be received and retained within a plurality of cavities formed between the tine-engaging skin and the plurality of supports.

The skins may be made of a woven fabric or mat of glass fibers and of a thermoplastics material.

The reinforcing slats of the grids may be made of a thermoplastic or a composite material.

The composite may be fiber-reinforced and may include a depolymerizable and repolymerizable thermoplastic polymer resin.

The resin may be a thermoplastic polyurethane.

The thermoplastics material of the skins may be a polyolefin and preferably polypropylene.

The cellular core of the deck may have an open-celled structure of the tubular or honeycomb cell type, constituted mainly of polyolefin and preferably polypropylene.

A plurality of spaced supports may support the deck adjacent corners and possibly other locations of the deck.

The at least one support may be made of a thermoplastics material, and substantially the entire pallet assembly may be recyclable.

The at least one support may further be a hollow thermoplastic foot and may interconnect the decks at their tine-engaging skins adjacent at least one of the edges.

A plurality of spaced supports may interconnect the decks at their tine-engaging skins adjacent the front, back and side edges of the decks.

The above object and other objects, features, and advantages of the present invention are readily apparent from the following detailed description of the best mode for carrying out the invention when taken in connection with the accompanying drawings.

DETAILED DESCRIPTION OF THE PREFERRED EMBODIMENTS

Figure 1:
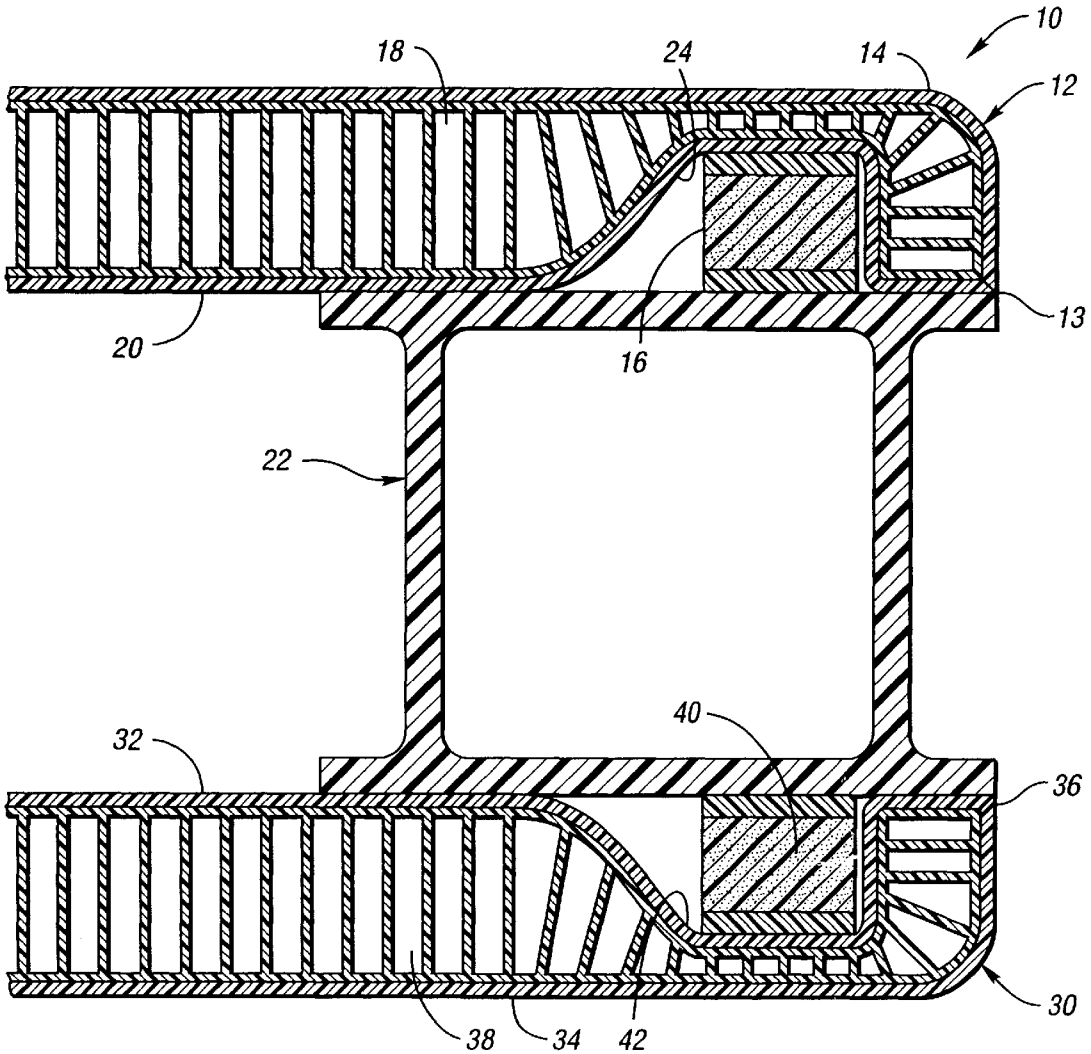
FIG. 1 is a side schematic view, partially broken away and in cross-section, of a double-deck design for a stackable and rackable pallet assembly of the present invention.

Referring now to the drawing Figures, there is illustrated in FIG. 1, a portion of a reinforced composite pallet assembly, generally indicated at 10, of the sandwich-type having a cellular core. The assembly 10 includes a substantially flat deck, generally indicated at 12, having front, back and side edges 13. The deck 12 includes a load-bearing skin 14 made of a reinforced thermoplastics material, a grid of reinforcing bars or slats 16, a cellular core 18 made of a thermoplastics material, and a tine-engaging skin 20 made of a reinforced thermoplastics material. The grid of reinforcing slats 16 are positioned at predetermined places against the tine-engaging skin 20 wherein the distance between the skins 14 and 20 is reduced during molding of the deck which molding locally crushes the core at the predetermined places. The assembly 10 also includes at least one support, generally indicated at 22, for supporting the deck 12 at the predetermined places against the reinforcing slats 16 so that tines can lift and support the pallet assembly 10 at the tine-engaging skin 20.

Figure 2:
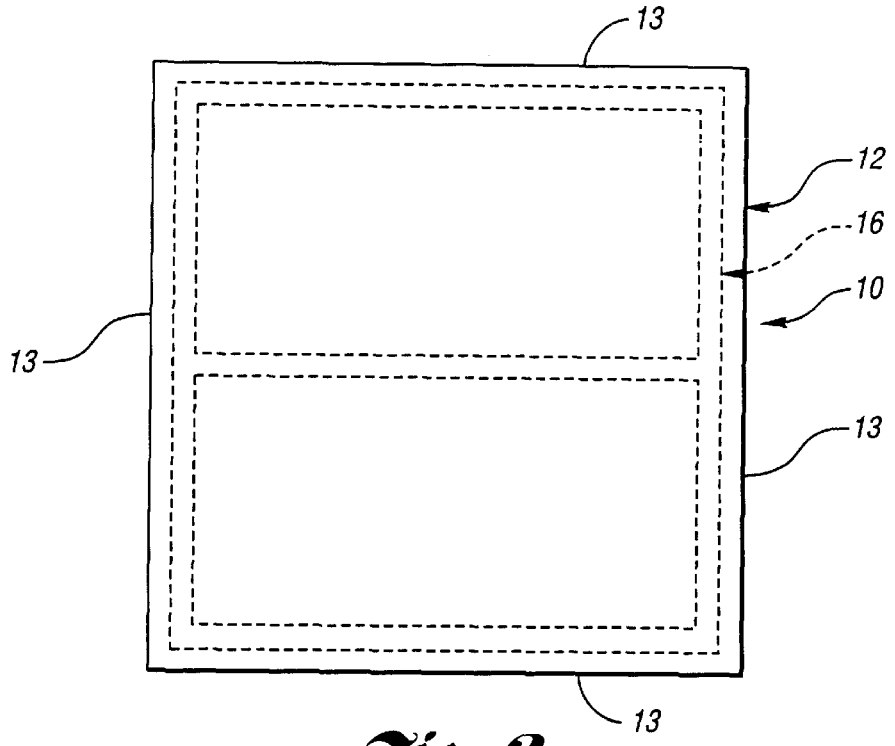
FIG. 2 is a top plan view of a pallet assembly of the present invention with a grid of reinforcing slats illustrated by phantom lines.
Figure 3:
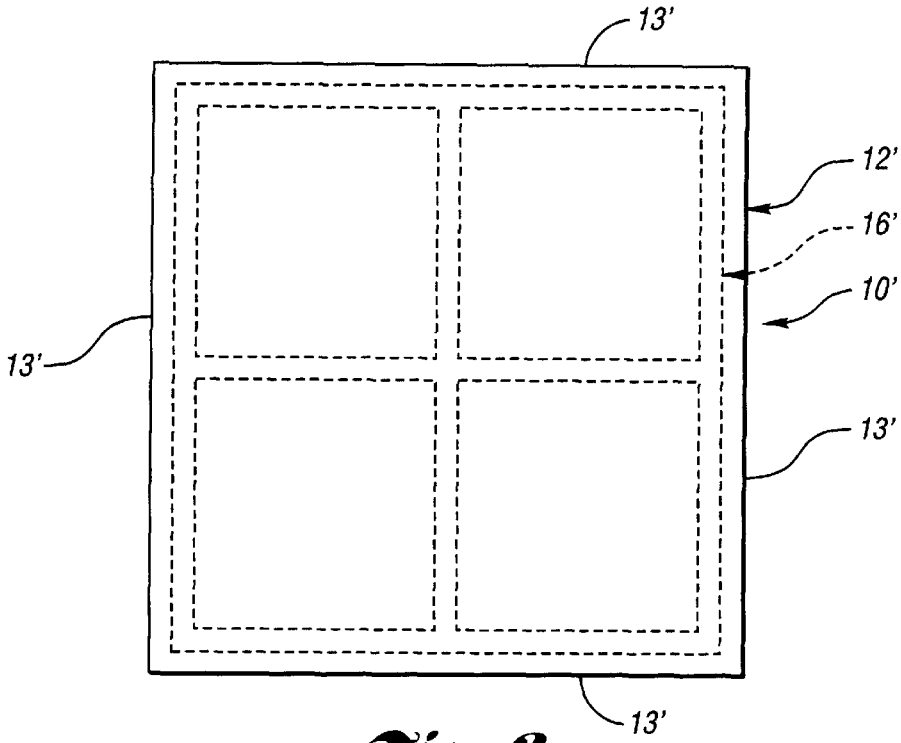
FIG. 3 is a top plan view of another pallet assembly of the present invention with a different grid of reinforcing slats.

The slats 16 of the grid are positioned adjacent to the front, back and side edges 13 of the deck 12, as best shown in phantom in FIG. 2. A central slat 16 extends across the deck 12. Referring to FIG. 3, another assembly 10' is shown which is substantially identical to the assembly 10, but central slats 16' of a grid of slats 16' extend from positions adjacent front, back and side edges 13' of a deck 12' to a center of the deck 12' for additional load support.

Referring again to FIG. 1, the load-bearing skin 14 extends downwardly to the tine-engaging skin 20 at the front, back and side edges 13 of the deck 12 so that the core 18 is substantially totally enclosed by the skins 14 and 20. In this way the edges 13 are finished not only for safe handling, but also to stop pest and dirt intrusion. Also, the finished edges 13 are cosmetically appealing.

The slats 16 of the grid are received and retained within cavities 24 formed between the tine-engaging skin 20 and the support 22.

The assembly 10 may further include a second deck, generally indicated at 30, also including a tine-engaging skin 32 wherein the at least one support 22 interconnects the decks 12 and 30 at their tine-engaging skins 20 and 32 and wherein the resulting assembly is at least stackable or rackable. A load-bearing skin 34 of the second deck 30 extends upwardly to the tine-engaging skin 32 at front, back and side edges 36 of the deck 30 so that a core 38 of the second deck 30 is substantially totally enclosed by the skins 32 and 34 of the second deck 30.

A reinforcing slat 40 is received and retained within a cavity 42 formed between the tine-engaging skin 32 and the support 22.

Preferably, a plurality of supports 22 support the deck 12 and wherein the reinforcing slats 16 and 40 are received and retained within a plurality of cavities 24 and 42, respectively, formed between their tine-engaging skins 20 and 32, respectively, and the plurality of supports 22. Also, supports such as the supports 22 typically support the deck 12 at two center edge locations on opposite sides of the deck 12. An additional support may also support the deck 12 at a center of the deck 12.

Materials Used for the Skins

The skin materials are made of a polyolefin such as polypropylene reinforced with fibers. However, other materials can also be used.

The properties of the skins depends on:

Glass content (typically 20 wt % to 60 wt %);

Glass orientation, woven 50/50 or 80/20 as needed for loads;

Structure of the reinforcement (continuous woven fibers, continuous UD fibers, random glass mats, chopped glass fibers, etc) and core; and Thickness, which depends on load and application but generally not to exceed 30 mm.

The skin is characterized by its weight per surface within a range of typically 400 to 1500 g/m2.

Some examples of the materials used for skins are:

Woven co-mingled fibers. Glass fibers and polypropylene fibers are co-mingled to form a hybrid roving. The process yields a product in which the glass fibers and thermoplastic fibers are uniformly dispersed. This co-mingling technique allows for a high glass fibers content (60 to 75 wt %) because it ensures a good fiber wetting by the matrix. Adequate wetting of the glass fibers ensures high mechanical performance of the composite. Hybrid rovings are then woven with several possible orientations. When the roving is heated above the melting point of the thermoplastic fibers, the thermoplastic flows around the glass fibers. The uniform co-mingling of the glass and thermoplastic fibers limits the distance the thermoplastic is required to flow and allows the material to be molded with very low pressures (about 10 bars). A commercial material is Twintex manufactured by Vetrotex Saint Gobain. Twintex is typically preconsolidated before being used in the process.

Mat of fibers with PP. It is a thin, continuous roll stock made of partially-consolidated polypropylene reinforced with fiber glass mat. Many thicknesses are available from a glass basis weight of 80 g/m2 up to 1000 g/m2. Glass content can vary from 20% by weight to 50% or more. The glass fibers are in a random configuration. It is also possible to use other types of fibers such as natural fibers, carbon fibers, and aramid fibers.

The reinforcing slats 16 and 40 of the grids are made of reinforced thermoset or thermoplastic composite such as a fiber-reinforced composite. The composite may include a depolymerizable and repolymerizable thermoset or a thermoplastic polymer resin such as a thermoplastic polyurethane.

The slats 16 and 40 may be solid or hollow elongated profiles using pultrusion techniques as described in U.S. Pat. No. 5,891,560. Such technology is generally known as Fulcrum® thermoplastic composite technology wherein Fulcrum® is a trademark of the Dow Chemical Co. of Midland, Mich.

Alternatively, the slats 16 and 40 may be made using a pultrusion technique to form a composite sandwich utilizing resin binders to form dense cores of glass, ceramic or phenolic microspheres with flanking long fiber reinforcements such as carbon, glass, aramid, matte, woven or other metallic or non-metallic materials such as wood or plastic.

Alternatively, the slats 16 and 40 may be made of other types of pultrusions or other materials such as metal.

Each of the cellular cores 18 and 38 of the decks 12 and 30, respectively, has an open-celled structure of the tubular or honeycomb cell type, constituted mainly of polyolefin and preferably polypropylene. However, three main areas of core technologies can be used, i.e., honeycomb-type materials, foams, and other shapes such as a wave. Honeycomb can be either cylindrical cells or hexagonal, square. Their axis is perpendicular to the surface of the sandwich. An example of a honeycomb structure that can be used consists of cylinders that are extruded (diameter typically 8 mm). Cylinder density is adjusted (cylinder size and wall stock) as needed for load. The tubes are heated and because they are made of two types of PP, the outer layer melts at a lower temperature than the inner, thereby bonding the tubes together. The blocks are then cut to the required thickness (typically between 5 and 30 mm).

While not shown, a plurality of spaced supports 22 support the deck 12 adjacent corners of the deck 12. The supports 12 are made of a thermoplastics material. In this way, substantially the entire pallet assembly 10 is recyclable. The supports 22 are preferably hollow thermoplastic feet which are hotplate welded or bonded to the skins 20 and 32.

In addition, the assembly 10 may include an outer covering layer made of a woven or non-woven material disposed on one or both of the skins 14 and 34. The outer covering layer may be made of foil or felt or of carpeting such as polypropylene carpeting.

An identification device in the form of a microchip or an RF identification card may be positioned within one of the hollow feet 22 to allows the pallet assembly 10 and its goods to be quickly and simply identified.

The process of forming each of the decks 12 and 30 is a thermocompression process. The two skins and the core of each deck 12 or 30 are stacked together and heated together in an IR oven. The preheated sandwich is then transferred into a cold tool. At this stage, there is no bond between the core and the skins. The sandwich structure is then stamped in the tool with a pressure of about 10 bars. The structure and the part are formed in a single step during molding. It is possible to place in the tool carpeting or foil on one or both sides of the sandwich.

The tool is typically designed to cut the sandwich and the carpet/foil during the molding step so that the finished deck comes out of the tool. Cycle time for the part is about 1 minute and varies only slightly with the thickness and the types of materials. Each of the decks 12 and 30 are locally crushed to form the cavities 24 and 32, respectively, and to also finish the edges 13 and 36, respectively.

U.S. patent application entitled "Method and System for Molding Thermoplastic Sandwich Material and Deep-Drawn Article Produced Thereby," filed Mar. 15, 2000 and having U.S. Ser. No. 09/525,785, discloses a method and system for molding thermoplastic sandwich material to form a deep-drawn article utilizing a clamping technique and mechanism. The deep-drawn material does not significantly stretch or tear during the method due to the clamping technique and mechanism disclosed therein.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A reinforced composite pallet assembly of the sandwich-type, the assembly comprising:

a substantially flat deck having front, back and side edges and including:

a load-bearing skin made of a reinforced thermoplastics material;

a grid of reinforcing slats;

a cellular core made of a thermoplastics material; and a tine-engaging skin made of a reinforced thermoplastics material; the grid of reinforcing slats being positioned at predetermined places against the tine-engaging skin wherein the distance between the skins is reduced during molding of the deck which molding locally crushes the core at the predetermined places to form respective pockets for the reinforcing slats and to produce the substantially flat deck; and at least one support for supporting the deck at the predetermined places against the reinforcing slats so that tines can lift and support the pallet assembly at the tine-engaging skin.

2. The assembly as claimed in claim 1 wherein slats of the grid are positioned adjacent to the front, back and side edges of the deck.

3. The assembly as claimed in claim 2 wherein at least one slat of the grid extend from positions adjacent the edges of the deck to a center of the deck.

4. The assembly as claimed in claim 1 wherein the load-bearing skin extends downwardly to the tine-engaging skin at the front, back and side edges of the deck so that the core is substantially totally enclosed by the skins and the edges are finished.

5. The assembly as claimed in claim 1 further comprising another deck as claimed in claim 1 wherein the at least one support interconnects the decks at their tine-engaging skins and wherein the assembly is at least stackable or rackable.

6. The assembly as claimed in claim 5 wherein the load-bearing skin of the another deck extends upwardly to the tine-engaging skin at the front, back and side edges of the deck so that the core of the another deck is substantially totally enclosed by the skins of the another deck and its edges are also finished.

7. The assembly as claimed in claim 1 wherein the cellular core of the deck has an open-celled structure of the tubular or honeycomb cell type, constituted mainly of polyolefin and preferably polypropylene.

8. The assembly as claim in claim 1 wherein a plurality of spaced supports support the deck adjacent corners of the deck.

9. The assembly as claimed in claim 5 wherein the at least one support interconnects the decks at their tine-engaging skins adjacent at least one of the edges.

10. The assembly as claimed in claim 5 wherein a plurality of spaced supports interconnect the decks at their tine-engaging skins adjacent the front, back and side edges of the decks.

11. The assembly as claimed in claim 1 wherein at least one reinforcing slat is received and retained within the respective pocket that comprises a cavity formed between the tine-engaging skin and the at least one support.

12. The assembly as claimed in claim 1 wherein a plurality of supports support the deck and wherein the reinforcing slats are received and retained within a plurality of respective pockets that comprise cavities formed between the tine-engaging skin and the plurality of supports.

13. The assembly as claimed in claim 1 wherein the skins are made of a woven fabric or mat of glass fibers and of a thermoplastics material.

14. The assembly as claimed in claim 1 wherein the reinforcing slats of the grids are made of a thermoplastic or a composite material.

15. The assembly as claimed in claim 14 wherein the composite material is fiber-reinforced.

16. The assembly as claimed in claim 15 wherein the composite material includes a depolymerizable and repolymerizable thermoplastic polymer resin.

17. The assembly as claimed in claim 16 wherein the resin is a thermoplastic polyurethane.

18. The assembly as claimed in claim 14 wherein the at least one support is made of a thermoplastics material and wherein substantially the entire pallet assembly is recyclable.

19. The assembly as claimed in claim 18 wherein the at least one support is a hollow thermoplastic foot.

20. The assembly as claimed in claim 13 wherein the thermoplastics material of the skins is a polyolefin and preferably polypropylene.

* * * * *